US005267800A

United States Patent [19]

Petteruti et al.

[11] Patent Number: 5,267,800

[45] Date of Patent: Dec. 7, 1993

[54] MINIATURE, PORTABLE, INTERACTIVE PRINTER

[75] Inventors: Alfred J. Petteruti; Steven F. Petteruti, both of East Greenwich; Ralph Almonte, Cranston; Majid Amani, Coventry, all of R.I.

[73] Assignee: Comtec Informations, Inc., Cumberland, R.I.

[21] Appl. No.: 926,258

[22] Filed: Aug. 6, 1992

[51] Int. Cl.[5] ..... B41J 3/36

[52] U.S. Cl. ..... 400/88; 346/76 PH; 400/120; 400/61; 395/148

[58] Field of Search ..... 400/86, 88, 120, 707.5, 400/708, 706, 613, 613.1, 614, 621, 61; 346/76 PH; 395/148; 101/292, 288; 156/541, 542, 238, 239, 361, 384, DIG. 44–47, DIG. 49

[56] References Cited

U.S. PATENT DOCUMENTS

| | | | |
|---|---|---|---|
| 4,264,396 | 4/1981 | Stewart | 156/361 |
| 4,358,333 | 11/1982 | Holland-Letz | 156/DIG. 49 |
| 4,626,313 | 12/1986 | Karp | 156/DIG. 45 |
| 4,647,235 | 3/1987 | Sato | 156/542 |
| 4,668,326 | 5/1987 | Mistyurik | 156/DIG. 49 |
| 4,712,114 | 12/1987 | Kikuchi | 400/613.1 |
| 4,724,033 | 2/1988 | Vanderpool | 156/DIG. 44 |
| 4,744,680 | 5/1988 | Hirosaki et al. | 400/120 |
| 4,765,765 | 8/1988 | Futakata | 400/613 |
| 4,826,558 | 5/1989 | Wada et al. | 156/384 |
| 4,871,269 | 10/1989 | Murata | 400/88 |
| 4,996,539 | 2/1991 | Haraga et al. | 346/76 PH |
| 5,033,882 | 7/1991 | Vanderpool et al. | 400/120 |
| 5,069,562 | 12/1991 | Matsuda | 400/708 |
| 5,092,688 | 3/1992 | Haennelt et al. | 400/88 |
| 5,163,766 | 11/1992 | Fushimi et al. | 400/88 |

FOREIGN PATENT DOCUMENTS

| | | | |
|---|---|---|---|
| 0120455 | 10/1984 | European Pat. Off. | 400/631.1 |
| 0187575 | 9/1985 | Japan | 400/613 |
| 0229777 | 11/1985 | Japan | 400/88 |
| 0139776 | 6/1988 | Japan | 400/88 |

*Primary Examiner*—Eugene H. Eickholt

[57] ABSTRACT

An intelligent, portable printer having a microprocessor controller, a printing mechanism and a web feed mechanism is integrated into an assembly which, together with a battery pack, may weigh about 2 pounds and be about 80 cubic inches in volume. The web has removable, adhesively attached labels which may be printed with bar codes, graphics, text or lines. Because the printer is so small and light in weight, it may be used at any site where labels are required. By labels is meant any tickets, stickers, or other patches of the type which are removably attachable to a carrier (so-called "label-stock"). The controller includes a microprocessor which communicates interactively with a terminal, which may contain a host computer, and which supplies data representing the material to be printed. The controller in the printer converts such data into the bar codes, graphics, text (in various fonts) or lines for operating the printing mechanism. The state of the printer is communicated to the terminal and both operate interactively to produce the labels.

19 Claims, 9 Drawing Sheets

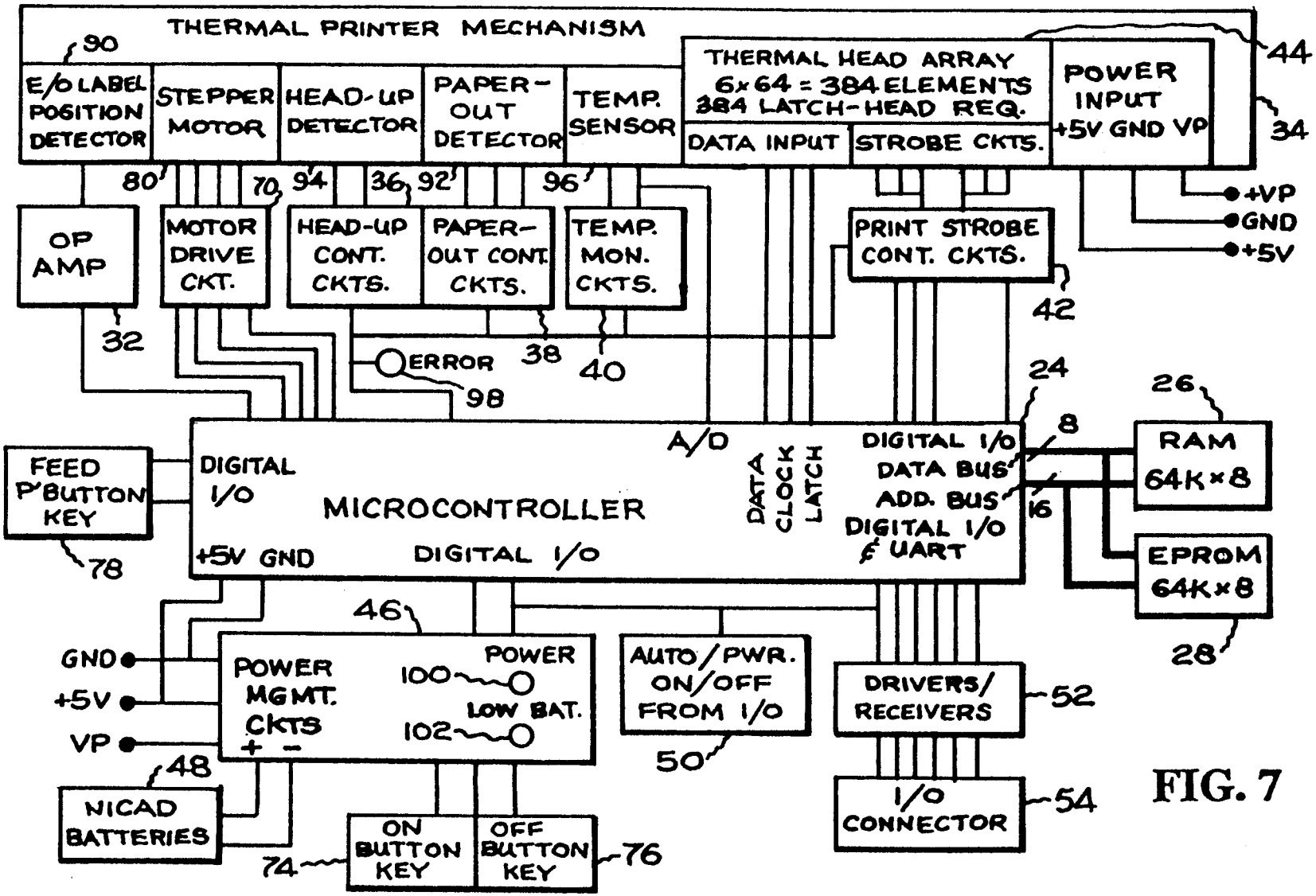
THERMAL PRINTER MECHANISM
E/O LABEL POSITION DETECTOR
STEPPER MOTOR
HEAD-UP DETECTOR
PAPER-OUT DETECTOR
TEMP. SENSOR
THERMAL HEAD ARRAY 6×64 = 384 ELEMENTS 384 LATCH-HEAD REG.
DATA INPUT
STROBE CKTS.
POWER INPUT +5V GND VP
+VP
GND
+5V
OP AMP
MOTOR DRIVE CKT.
HEAD-UP CONT. CKTS.
PAPER-OUT CONT. CKTS.
TEMP. MON. CKTS.
PRINT STROBE CONT. CKTS.
ERROR
RAM 64K×8
EPROM 64K×8
DIGITAL I/O
DATA BUS
ADD. BUS
DIGITAL I/O & UART
DATA CLOCK LATCH
A/D
MICROCONTROLLER
DIGITAL I/O
DIGITAL I/O
+5V GND
FEED P'BUTTON KEY
DRIVERS/ RECEIVERS
I/O CONNECTOR
AUTO/PWR. ON/OFF FROM I/O
POWER
LOW BAT.
POWER MGMT. CKTS
GND
+5V
VP
NICAD BATTERIES
OFF BUTTON KEY
ON BUTTON KEY
FIG. 7

MINIATURE, PORTABLE, INTERACTIVE PRINTER

DESCRIPTION

The present invention relates to printers which are operated by digital data and particularly to a miniature, portable, intelligent printer which is interactive with a terminal, which supplies data representing material to be printed to the printer.

A printer provided by the invention is especially suitable for use in portable printing to print labels (by which is meant shelf labels, tickets, stickers and other patches) which may be adhesively, releasably attached to a web carrier (so-called "label-stock") and to perform such printing on site (in the warehouse, retail store or factory where the labels are required) because the printer is portable and miniature in size. The size of a printer provided by the invention may be about 80 cubic inches (e.g. 5.5 inches high by 4.25 inches long×3.25 inches wide) and the weight of the printer may be about 2 pounds.

Label printers have been used on factory floors, in warehouses and in retail establishments for ticket printing and inventory control. Many such printers have their printing mechanisms and control computers housed in suitcases as separate elements interconnected by wiring. The suitcases are opened in order to put the printer to work for label printing. Flexibility is necessary in the control of the printer mechanism and in order to enable the printing of various kinds and types of material, including bar code formats. The suitcase printer packaging had room also for a key pad as well as a terminal. By a terminal is meant a host computer or other input device which provides data to the printer, such for example, as an optical character reader or bar code scanner. The terminal may be a cash register with its associated input device, such as the aforementioned optical character recognition device or bar code scanner or a magnetic stripe reader. The terminal may be associated with some or all such input devices and may be connected to the host via a hard wire or radio communication link. Flexibility to print various input data in the desired style, format, text, graphics or the like provides printing power necessary for the various label printing operations and any other mobile applications where printing is required on-site.

Another requirement of a portable printer is that it be interactive with the terminal which provides data for printing so that the data can be transferred when it is usable by the printer and not when the printer is busy or in some other state where it cannot handle the data, for example, where the label stock is not loaded in the printer or used up or where the operating power is below limits (low-battery), or the printer is not otherwise ready to accept data for printing. The printer must also have the capability of handling label stock of various width, and facilities for loading and threading of the stock in the printer mechanism. Alignment of the labels with the printing mechanism, preferably automatically, is desirable. Then printing takes place on the label with each element (block, line, text or bar code) at the coordinates dictated by the data which is transmitted to the printer for block or element location. Various other printing functions are desired, such as striking over or double printing (repetitive printing of the same material on successive labels), control of contrast, printer run time (length of paper printed over the life of the printer), serial number recording so that the printer can be identified to the terminal, and various power saving functions to extend battery operating time between charges, such as to power the printer down and turn off the printer mechanism, and even the controller thereof, when the terminal is not utilizing the printer (the printer then turns on and off with the terminal).

With label printers, it is desirable to facilitate the removal of printed labels after printing by peeling them from the web on which they are carried and adhesively and releasably attached. The handling of the web after the labels are printed and removed to enable the used web to be collected so as to prevent interference with printing operations and to facilitate disposal or recycling of the web material is also desired.

It is the principal feature of this invention to provide a printer in which all of the foregoing requirements can be satisfied without the need for volume and weight, such as in the suitcase size portable printers which have heretofore been available. A printer in accordance with the invention is self-contained in a volume which enables the printer to be easily carried, for example, on a belt hook or with a shoulder strap, thereby minimizing operator fatigue. A feature of the invention is to provide a printer having a housing, which may include a battery pack, which is no more than about 80 cubic inches in volume and about 2 pounds in weight, notwithstanding that the printer contains a label printing mechanism capable of printing labels about 2½ inches wide and about 4½ inches long, a computer controller, a key pad and facilities for receiving rolls of label stock and feeding the stock through the printing mechanism.

Another feature of the printer is the use of a peeler mechanism which enables the labels to be peeled away from the carrier web after they are printed, which does not interfere with the loading or threading of the web in the printer. The ability to reel up the carrier web, without adding significant weight or volume is another feature which the invention can provide.

Still another feature of the printer provided by the invention is in the electronic controller which is intelligent and is programmed to respond to the status of the printer as well as to commands for operating the printing mechanism, including controlling the print contrast, turning the printer mechanism and itself on and off (for power-battery conservation), as well as to convert the data into the format or style (bar code, text, graphics or lines) as dictated by the commands accompanying the data representing the material to be printed.

Another feature of the printer is to allow various elements of blocks to be printed at desired coordinates (x,y) on the label by aligning the label with respect to the printing elements of the printer mechanism, so that the coordinates represented by the commands to print various elements in various locations correspond to the actual position of the label while passing through the printer mechanism during printing.

Briefly described, a printer embodying the invention is responsive to data representing the information to be printed and control commands which are communicated to the printer from a terminal. The printer has a printing mechanism including printing elements. The printer includes a spool for receiving a roll of web stock on which printing is carried out. This web stock may carry labels at successive positions along the length thereof which are releasably, adhesively attached to the web and are removable after printing by a peeling mechanism provided by the invention. The printing mechanism has means for feeding the stock past the printer elements. This feeding means may be a platen roller around which the stock is entrained. The printing elements of the mechanism may be thermal printing elements which bear on the label side of the stock and press the stock against the platen roller. After printing, a peeler bar, which may be generally wedge shape, extending away from an apex edge from the web, is positionable adjacent to the roller. As the stock turns on the roller the label releases due to the adhesive force being insufficient to maintain the connection between the label and the web when it turns around the diameter of the roller. The edge of the peeler bar engages the released portion of the label and the label is driven over the surface of the peeler bar, which may be ribbed in order to facilitate removal of the label manually from the peeler bar. At the same time, the web is taken up on a take-up shaft which may be turned manually to collect the web from which the labels have been removed. The printer also includes an electronic controller responsive to the commands from the terminal and to data for operating the printer mechanism. The printer mechanism has sensors and outputs which represent its status. The controller is interactive with the printer and has means for transmitting status messages representing the state of the printer to the terminal. A housing contains the printing mechanism, a spool on which a roll of stock is received, and all of the other stock drive and handling facilities of the printer. The controller is also contained in the housing. The housing may have a key pad on a surface thereof and receive a battery pack having batteries for operating the printing mechanism and the controller. The housing and all of the above-mentioned components thereof comprise a self-contained integrated assembly. The weight of the assembly can be about 2 pounds (e.g., 2 lbs., 3 ozs.) and its volume can be about 80 cubic inches (e.g., 81 cubic inches). Notwithstanding the small size and low weight of the printer, it has all of the functions necessary for on-floor or on-site portable printing and thus constitutes a miniature, portable interactive and intelligent printer.

The foregoing and other features, objects and advantages of the invention, as well as a presently preferred embodiment thereof, will become more apparent from the reading of the following description in connection with the accompanying drawings in which:

FIG. 7 is a block diagram of the electronics associated with the printer mechanism and the controller;

Figure 1:
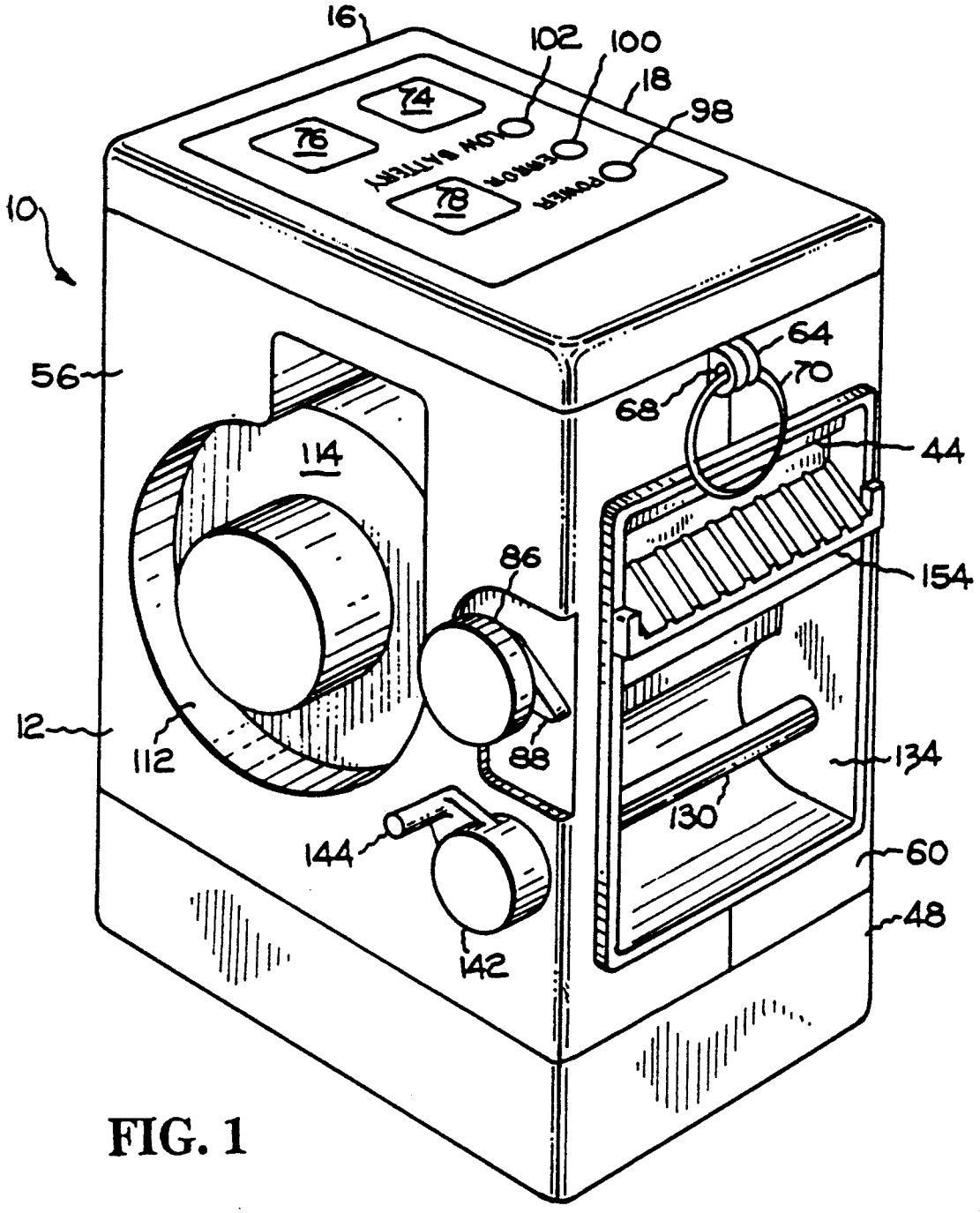
FIG. 1 is a perspective view showing the front, top and one side of a printer embodying the invention.

Referring to FIGS. 1 through 4, there is shown a miniature printer 10 having a housing 12 which is generally rectangular in shape. The housing is made of shells 14 and 16 molded of plastic material, preferably polycarbonate. The housing has a separable top 16 in which is disposed a key pad 18. A flexible cable 20 from the key pad is connected to a controller assembly 22 disposed below the top 16. The assembly 22 includes the computer and input and output circuits therefrom which are illustrated in FIG. 7. These circuits are the microcontroller 24, a random access memory (RAM) 26 and a read only memory in the form of an erasable, programmable read only memory (EPROM) 28. These memories are connected by an 8 bit (8 line) data bus and a 16 line address bus. There are sensor and control circuits, namely a motor driver circuit 30 and operational amplifier circuit 32, which buffers signals from an electro optical (E/0) detector of the thermal printer mechanism 34, control and monitoring circuits 36, 38 and 40 and control circuits 42 which operate the printer elements in the thermal head array 44 of the thermal printer mechanism 34. There are also power management circuits 46 which control the application of power from batteries in a battery pack 48, an automatic power on/off control circuit 50 which controls the powering up and down (on/off) of the printer including the controller and the thermal printing mechanism, and interface circuits 52 in the form of drivers and receivers which operate in accordance with the RS232C protocol and are connected to an input/output (I/0) connector 54.

The housing 12 has opposite sidewalls 56 and 58 and front and rear walls 60 and 62. Bosses 64 and 66 extend from the front and rear walls, respectively, just below the top 16. These bosses have holes 68 in which rings 70 are captured. These rings may be connected to a strap or chain (not shown) which may be used to connect the printer to the belt of the operator or may be extended to provide a shoulder strap for the operator to carry the printer on his or her shoulder. The key pad 18 has a key 74 for turning the printer on, a key 76 for turning the printer off, and a key 78 for starting and stopping the paper or web label stock drive motor which is part of the printer mechanism. These keys may be push-buttons. This motor is a stepper motor 80 which is part of the printer mechanism 34 shown in FIG. 7. The printer mechanism is a thermal printer 34.

Figure 4A:
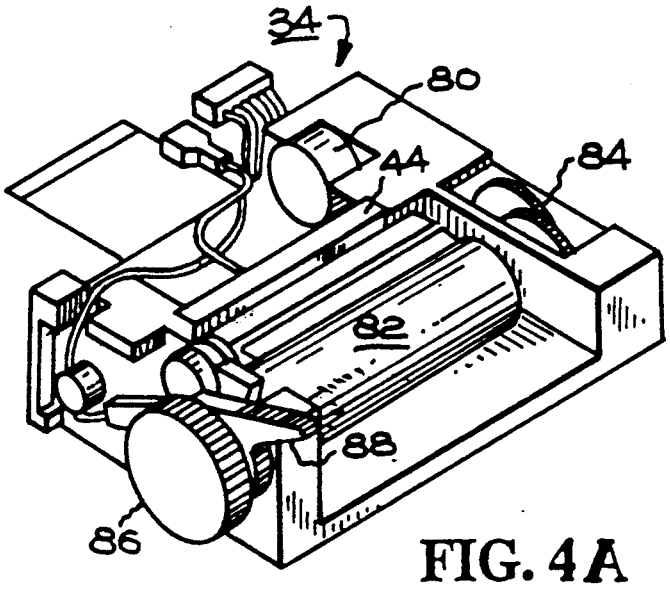
FIG. 4A is a perspective view of the printer mechanism.
Figure 4:
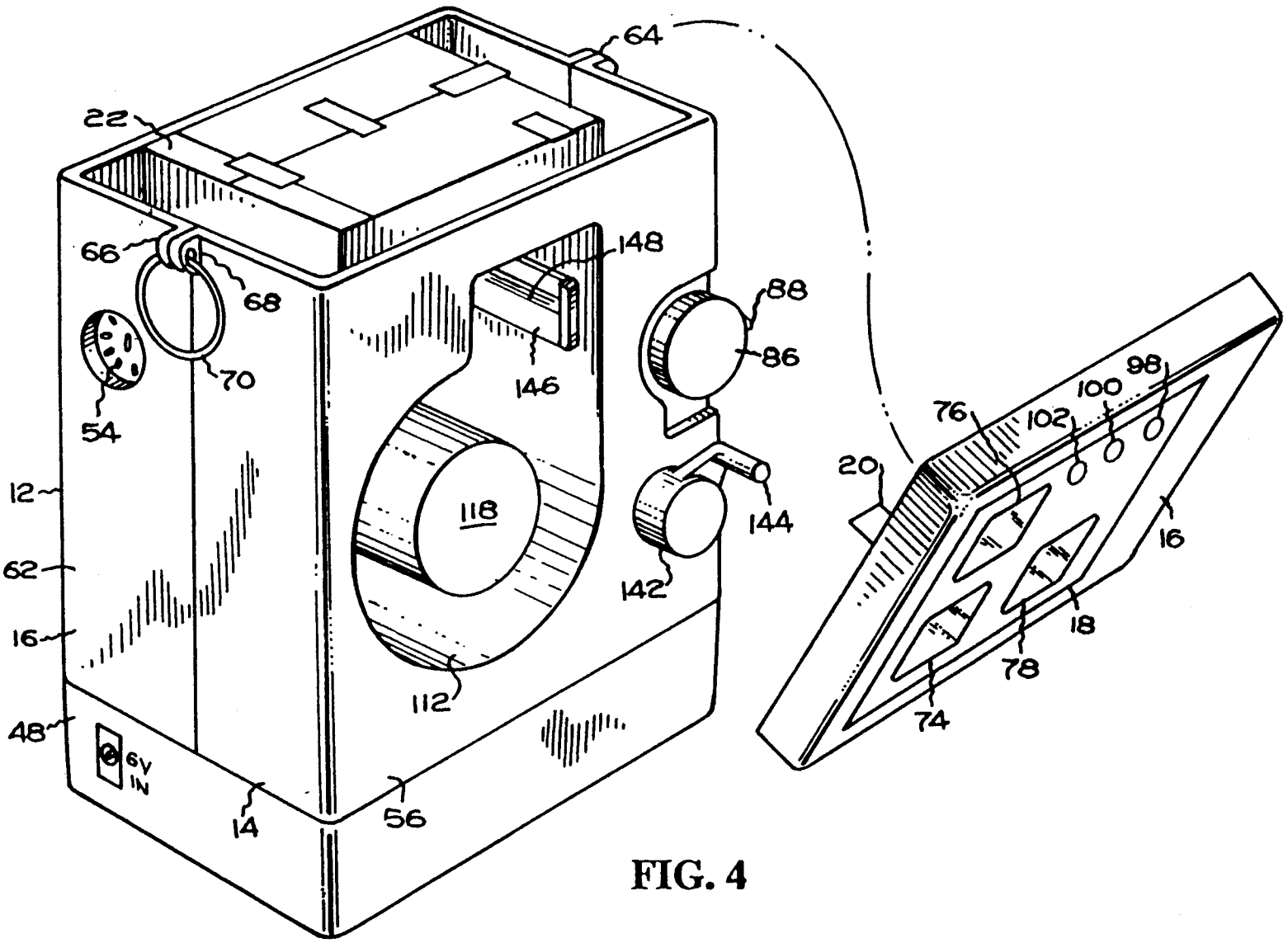
FIG. 4 is a perspective view of the printer shown in FIGS. 1 through 3 showing the rear, side and top and with the top cover removed to illustrate the location of the controller board and the printer mechanism.

The assembly constituting this printer mechanism 34 is shown in FIG. 4A where the motor 80 is shown. This motor 80 is connected to a platen drive roller 82 by a gear train 84. The thermal printer mechanism's thermal head array of printing elements 44 is disposed adjacent to the roller 82 and acts as a pressure pad to hold the stock against the roller so that the stock may be driven by the roller when it is driven either by the motor 80 or a feed knob 86. Underneath the feed knob 86 is another knob 88 having a nose which cams the thermal printer array (consisting of a metal heat sink bar and an insulating bar in which a row of 384 elements is contained) away from the platen roller 82 to a release position. The thermal head array 44 and its heat sink bar is referred to as a thermal head, and is moved from its release position away from the roller 82 to a drive position against the roller where it presses the printer stock against the roller 82.

The thermal printer mechanism has, in addition to the motor, an electro-optical assembly 90 (see also FIG. 7) and an electro-optical paper out detector 92 which receives light from a light emitting diode (LED) in the paper out detector 92, when the paper path is clear and not blocked by the stock. There is also a head up detector 94 which is a switch operated by the release latch knob 88. There is also a temperature sensor 96 in the printer mechanism 34 (a thermister) which detects the temperature of the thermal head array 44 and provides an output to the microcontroller 24 which has an analog to digital converter (A/D). The temperature monitoring circuits 40, the head up control circuits 36 and the paper out control circuits 38 when the temperature is too high, the paper is out or the head 44 is released operate, through the microcontroller 24, causes the controller to illuminate an error LED 98. There are also LEDs 100 and 102 associated with the power management circuits 46 which illuminate when the battery is low and when the printer is on. These LEDs are exposed by openings in the key pad 18.

The controller 22 is mounted on a printed circuit board 106. The board 106 is connected to the I/0 connector 54 which is mounted on the rear wall 62 of the housing 12. This connector also has inputs from the power management circuits 46. It may be desirable to wrap the controller board and the components mounted thereon in an electromagnetic interference (EMI) shield 110 provided by electromagnetic field shielding material, for example, fabric covered by conductive material which is connected to ground.

Figure 3:
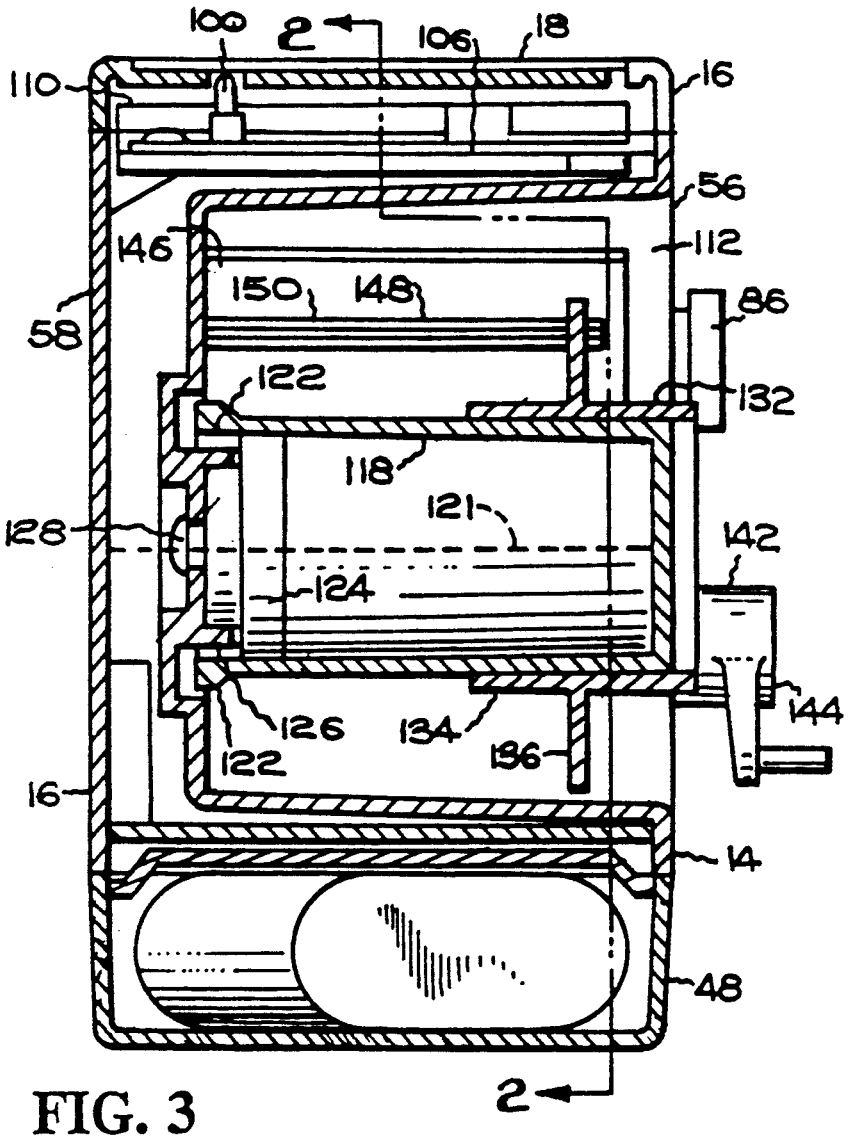
FIG. 3 is a sectional view of the printer shown in FIGS. 1 and 2, the section being taken along the line 3—3 in FIG.2.

One of the sidewalls 56 of the housing 12 has a recess 112 which is a cup shaped indentation in the housing half shell 14 (see FIG. 3). This indentation has a section 114 which is generally rectangular in shape and extends from a forward end to approximately a bisecting diameter 116 of the recess 112. This section 106 provides access for the fingers of the operator to assist the operator in loading the stock 120 in the printer mechanism.

The stock 120 comes on rolls and includes a web of paper which is calendared on one side so as to enable the releasable attachment on that side of the web (the side which is contacted by the thermal head array 44) for printing thereon. This stock comes in rolls on a core. The core is tubular and it and the rolls may be of different axial length, for example up to 2½ inches in axial length (the width of the stock). The stock is preferably white and reflective and has printed thereon black lines or bars between the labels which demarcate the location of the labels. These bars are used for self-alignment purposes as will be explained in greater detail below.

Figure 5:
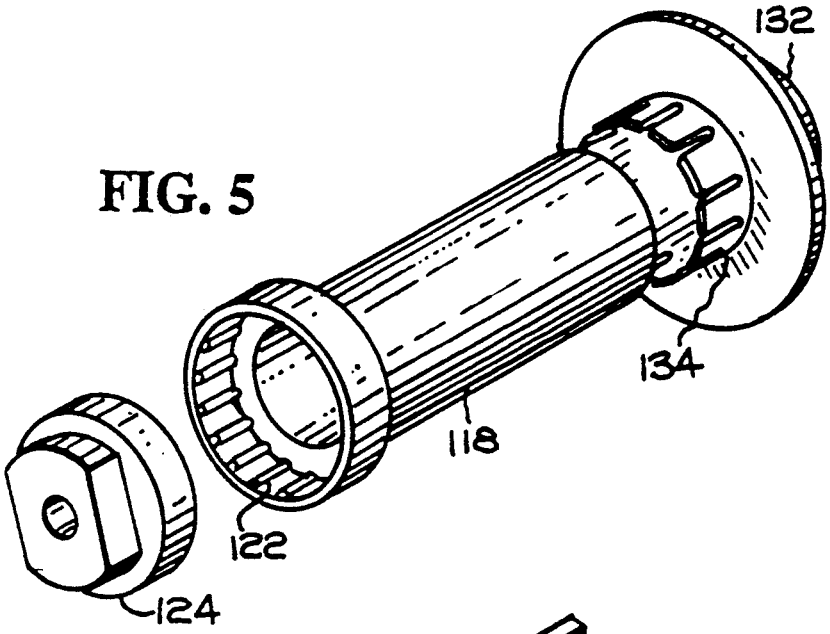
FIG. 5 is a perspective, exploded view of the spool assembly.

The rolls of stock material are received on a spool 118 (see FIGS. 2 and 3) which is conically tapered along the rotational axis 121 of the spool towards the side wall 56 and the entrance of the recess 112. The rear end of the spool 118 has tapered wedges 122 which are received on the outer periphery of a bearing assembly 124 (see also FIG. 5). This bearing assembly is connected to a boss 126 on the inside of the indentation in the half housing section 14 which forms the recess 112. The bearing assembly 124 is connected as by a bolt 128 to the boss 126. When the stock spool 118 is positioned on the bearing assembly 124, it forms a tight friction fit and a cantilever support at the bearing assembly 124 which allows the spool to rotate freely (free wheel). The stock material is fed solely by the platen roller 82, or alternately and optionally by winding it onto a take-up shaft 130 (see FIG. 2). The bearing assembly 124 may include ball bearings 130 so as to rotatably mount the spool and the roll of stock material which is held thereon. The roll of stock material may, as noted above, be of different widths, but is held firmly on the stock spool by a stock retainer collar 132 having flexible fingers 134 in a circular array (see also FIG. 5). These fingers extend inwardly from a flange 136 and enter between the tapered peripheral surface of the spool 118 and the interior peripheral surface of the roll of stock material. The flange is located laterally depending upon the width of the roll of stock material.

Figure 6:
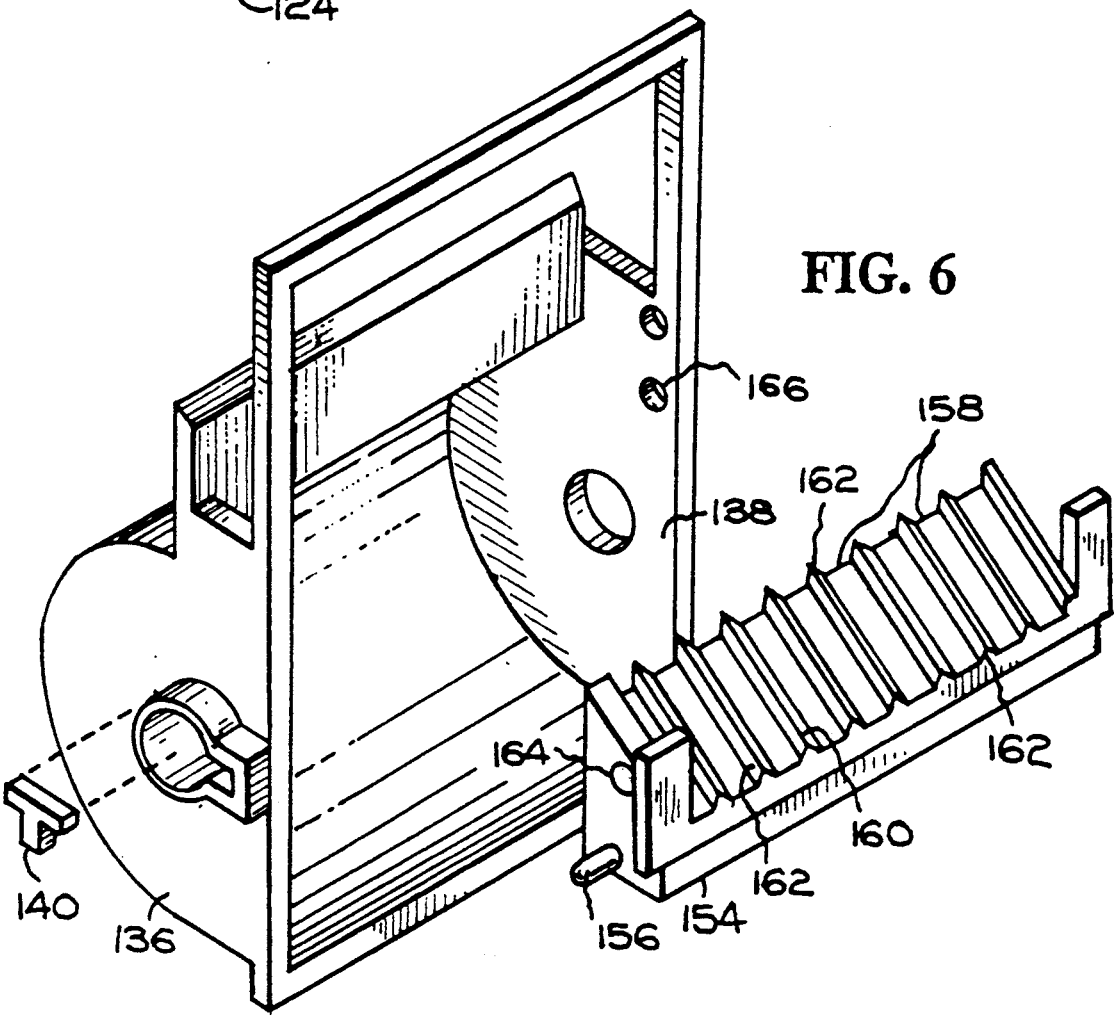
FIG. 6 is a perspective, exploded view showing the peeler bar mechanism and the frame in the housing to which it is pivotally connected.

The front 60 of the housing 12 has an opening 134 in which is fit a frame 136 (see also FIG. 6). This frame has a semi-cylindrical section 138 in which the take up shaft 130 is mounted. This shaft has a slot in which the web backing of the label stock is inserted. The shaft is connected to a ratchet mechanism within a crank 144 to a retrieval knob 142 having a crank 144. The ratchet 140 prevents rewinding (backward winding) of the take up shaft 130 except over a short arcuate distance to enable the tension in the material 120 to be relieved. The take up shaft need not be used, but is a feature to prevent the web after the labels have been printed and removed to be collected, if desired.

The thermal printer mechanism 34 is mounted behind the front wall 60 in the frame 138 close to the top of the printer. To facilitate feeding of the stock between the platen roller 82 and the thermal array, there is provided (See also FIG. 4) a stock funnel 146 with an inlet adjacent to the section 118 which tapers inwardly to an outlet adjacent to the thermal printer mechanism 34. The inlet opening of the stock funnel 146 is shown at 148 and the narrower outlet opening is shown at 150. The label stock may be loaded automatically or manually. For automatic loading, the head 44 is released using the head release latch 88. This opens a path to permit the stock to be slid between the head 44 and the roller 82. When the head closes, the motor 80 is automatically turned on and it feeds until the electro optical detector 90 sees a lack of reflected light which indicates the location of a line or bar which is printed on the web. The motor then stops. It may be desirable to remove several labels manually and thread the end of the stock into the slot in the take up shaft 130. The loading may also be accomplished by leaving the head in engaged (on the roller 82) position. Then insertion of the stock into the funnel to the printer mechanism 34 starts the motor. The motor then runs until it sees a black line. The controller has a maximum run length control, for example to allow the motor to run so that the stock is advanced approximately 10 centimeters. This timeout operation is a safety backup against excessive feeding of the stock during loading.

Figure 2:
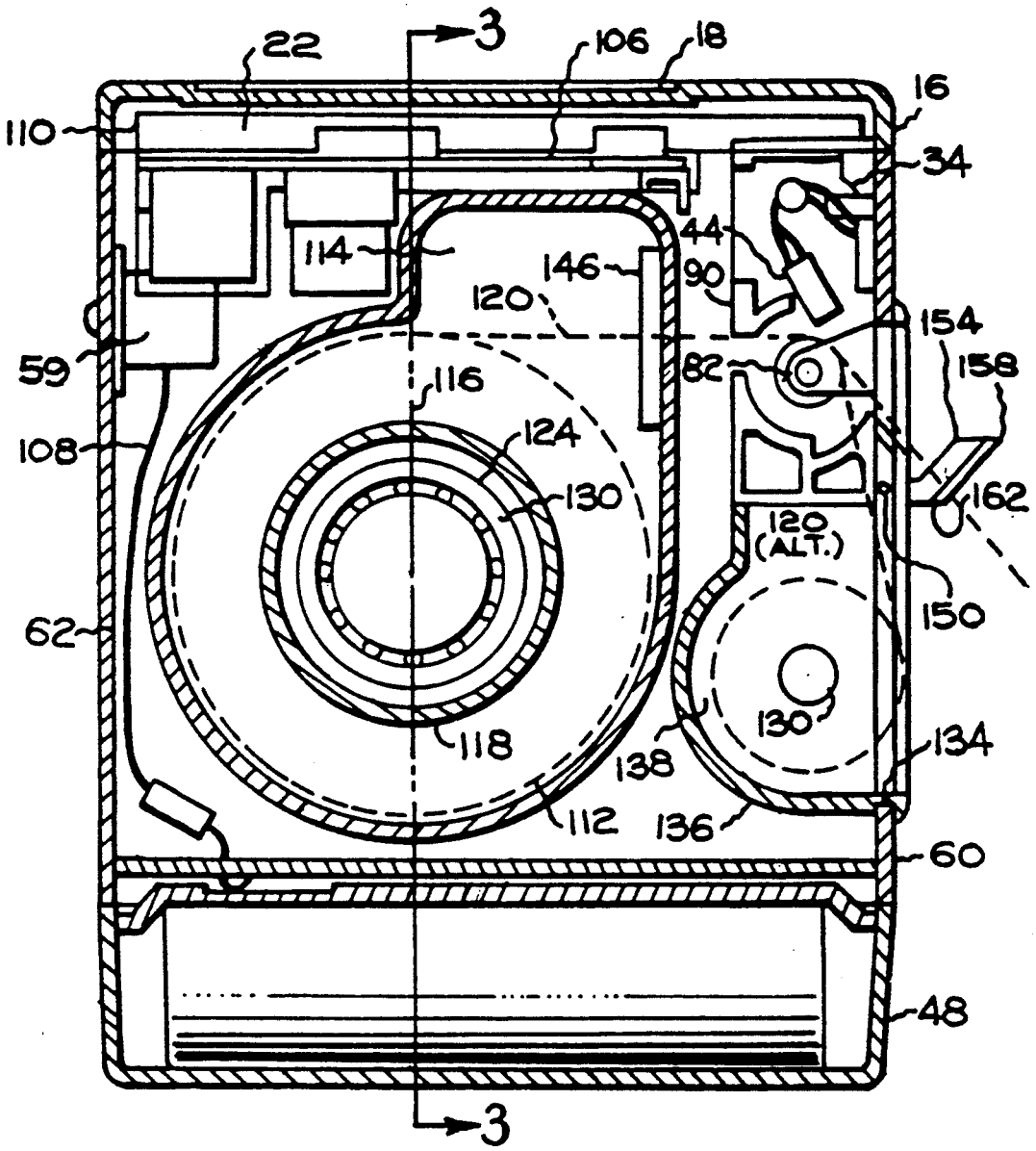
FIG. 2 is a sectional side view of the printer shown in FIG. 1, the section being taken along the line 2—2 in FIG. 3.

As shown in FIGS. 1, 2 and 6 the printer is equipped with an automatic label peeler mechanism having a peeler bar 154. This bar extends across the opening 134 and is pivotally mounted on pins 156 to the frame 136. The bar is a wedge with a leading edge 158 and a label receiving surface 160 made up of the upper edges of ribs or teeth 162 which extend in a direction in which the labels are fed out of the printer. When the web with the printed labels attached executes an arc around the roller 82, the adhesive holding the labels to the web exerts a holding force which is insufficient to prevent the leading edge of the label from releasing from the web. The web at that time is passing through a gap between the peeler bar 154 and the surface of the roller 82. The released edge of the label engages the edge 158 of the peeler bar and the label continues to be fed by the roller 82 as the peeler bar assists in releasing the label. The released label is held on the surface 160, which is a low friction surface because it is of limited area, being provided only by the edges of the ribs 162. The bar 154 may be made of material, such as Teflon, which has a lower coefficient of friction than the web. Also, some of the ribs 162 may be of shorter height above the surface 160 than others; for example, the first and second sixth and eighth ribs (counting from the left as viewed in FIG. 6) may be shorter by about .030 inch than the other ribs.

In normal operation, the labels are printed one at a time and the operator can remove the printed label from the surface 160 and apply it to the item to be labeled. Then, the labels can automatically be peeled by the peeler bar 154. If desired, the system can be operated in a form feed mode. The peeler bar is then pulled back away from the roller 82. The printed labels can be then peeled from the web, which can be torn at the edge 158.

A detent mechanism consisting of indentations 164 at the ends of the peeler bar 154 and projections 166 in the frame 136 which can flex outwardly as the peeler bar is pivoted toward the frame 136 may be used to locate the peeler bar either in label peeling position adjacent to the roller or away from the roller as when continuous form feed of the stock is desired; then allowing the labels to stay attached to the web so that they can be removed manually by the operator when and as desired. Other types of latching mechanisms may be used to position the peeler bar 154 in peeling or release position. Such mechanisms may include toggle springs or springs which normally bias the bar to peeling position so that the bar is held back manually when the label is to be threaded through the gap between the roller and the edge 158 of the peeler bar 154.

The printer 12 constitutes an integrated assembly of all of the components discussed above, the principal ones of which are the electronic controller 22, the printer mechanism 34 and the spool 118 and other winding components for the stock. This integrated assembly is light in weight and may be of a weight not exceeding two pounds. The dimensions of the assembly including the battery pack 48 may be 5.5 inches high, 4.25 inches long and 3.25 inches in width; a total volume of about 80 cubic inches.

The printer 12 is adapted for control and to receive data representing the information to be printed from a terminal which is connected to the printer by way of the I/0 connector 54. The illustrated connection is a wire connection using an RS232 protocol. It will be appreciated, of course, that the interconnection may be by other hard-wire methods, such as RS485 or parallel methods, by a radio or light wave (e.g., infra-red) communication link. There are several signals which are applied to the controller by way of the I/0 connector 54 from the terminal. These may be a signal on one connector pin or line over which data is received into the printer. This is called the TXD line. Another input from the terminal is a line indicating that the terminal is ready to send and is called the RTS line. There is a ground line and a line from the terminal providing a so-called "soft on/off" which enables the terminal to turn the printer on when the terminal is turned on and turn the printer off when the terminal is turned off as when battery conservation is desired. This line is called the DTR line. The printer is interactive with the terminal and transmits data to the terminal over a line which is connected to a pin of the connector 54 called the RXD line. It also provides a signal indicating that the printer is clear to receive commands and data. This is called the CTS line. There is also a line which is used to acknowledge to the terminal that the printer is on when it is set high. This is called the DSR or data set ready line. The interactive information to the terminal may be an 8 bit data signal or status byte, individual bits of which have the following meaning: printer busy; paper (label stock) out; head array up or down (latched); battery voltage high or low; reset (meaning that the printer has been powered down or shut off); motor direction (the motor 88 is a two-phase stepper motor which can be driven to feed out or take in the stock depending upon the sequence of pulses which are applied to the phases via the motor driver circuit 70—see FIG. 7); and two print contrast bits. The thermal head array is capable of different degrees of darkness or print contrast by switching on strobe pulses which control gates which apply current via the print strobe circuits 42 from the digital I/0 (pulse width modulated) outputs of the microcontroller 24 (see FIG. 7). There are 2 bits indicative of 4 levels of print contrast. The normal print contrast level may be when the 2 bits are equal to 0 and the controller is designed to default to that print contrast state.

The system may also be designed to provide different "effect" modes of printing. The normal mode is a "OR" mode in which either new data or old data is applied to the printhead. Another mode is the "EXCL-OR" mode. This is the exclusive OR mode which enables use of existing data for printing or new data for printing whichever is present to be used. This allows old or new data to be used for different elements of the label in different blocks or coordinates thereon where printing may be carried out. The other effect mode is the "AND" mode wherein the new data will write over the old data even though the old data is present. The printer mechanism has gate circuits for providing strobing, a latch register in which the data for a line of 384 dots is stored and a shift register in which the data for a line is entered and then transferred to the latch register and to provide current for the printing elements via the gates when they are strobed on. The microprocessor provides data one line at a time to the shift register over the data line to the data input of the head 44. The register receives clock pulses over the clock line and the data from the shift register is transferred to the latch register when a latch pulse is received over the latch line. The speed of the motor is controlled in response to signals from the temperature sensor so that the line feed is synchronized with the data input to the head 44. The motor may be driven in the take-up direction when striking over or double printing on the same label or the same line of the label is desired. In the illustrated printer mechanism, because of the capacity of the RAM in which the data representing the material to be printed is stored, the maximum number of lines is 670.

The RXD line may also provide data to the host concerning print contrast, the battery level, the serial number of the printer and an odometer reading as to how much printer stock has passed through the head. This reading may be obtained by retaining a count of the number of bars which are detected by the EO label position detector 90. This count is translated into meters of stock and can be read out from the printer to the host or printed on a label.

The controller also provides self test capability. This self test can be accessed using the feed on an off keys. The feed key is held on while the on key is actuated. Then the on key is released and the feed key is released. The printer is then commanded to print bars which will show if there are any gaps in the print area. The label will also have the revision number of the program which is stored in the EPROM 28, the battery voltage, printer serial number, low battery trip point, head temperature, and the status byte. Other patterns may be printed out, for example checkerboard patterns for self test purposes.

Figure 8:
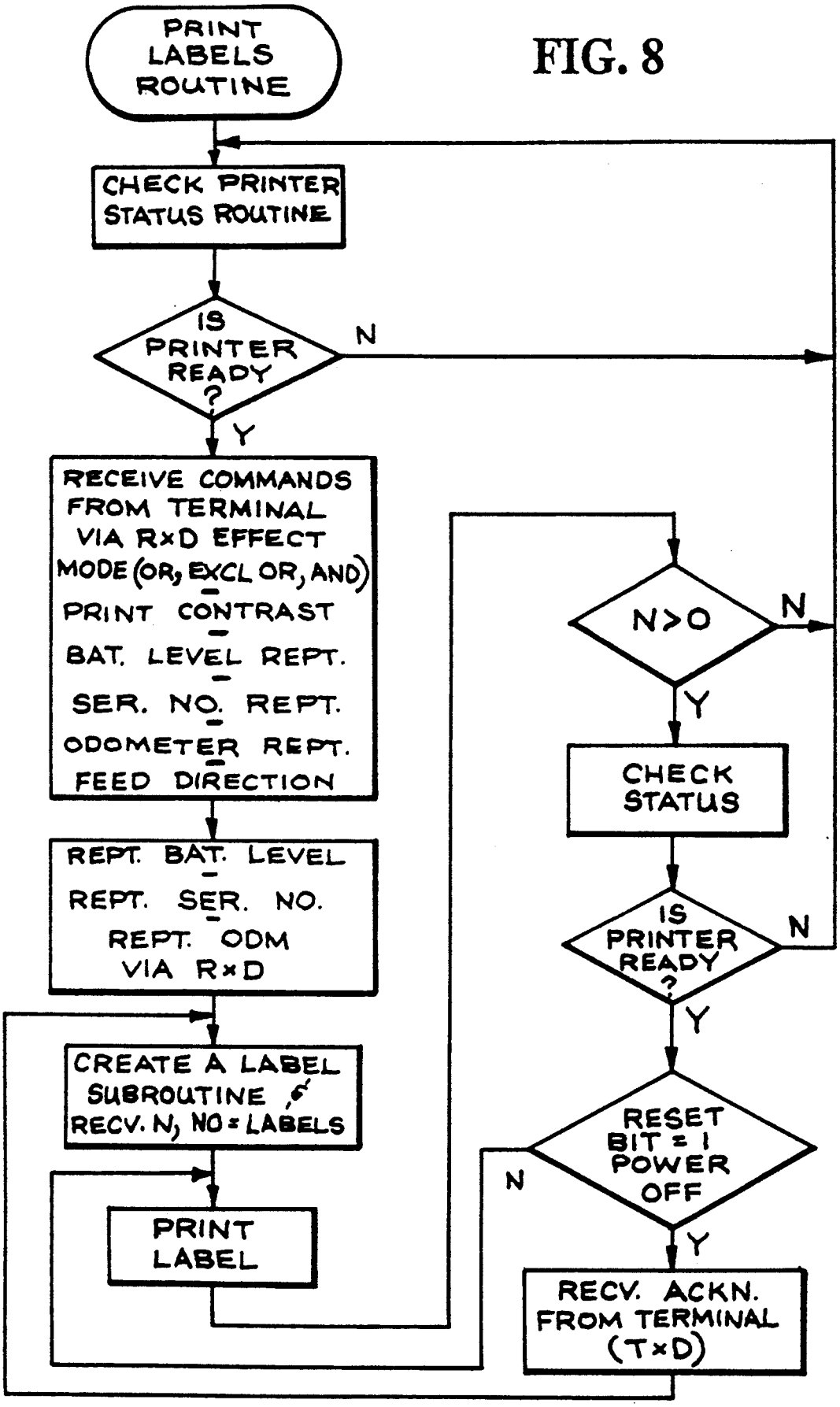
FIG. 8 is a flow chart illustrating the computer system operation (the program) for printing labels which is carried out in the computer system of the controller shown in FIG. 7.
Figure 9:
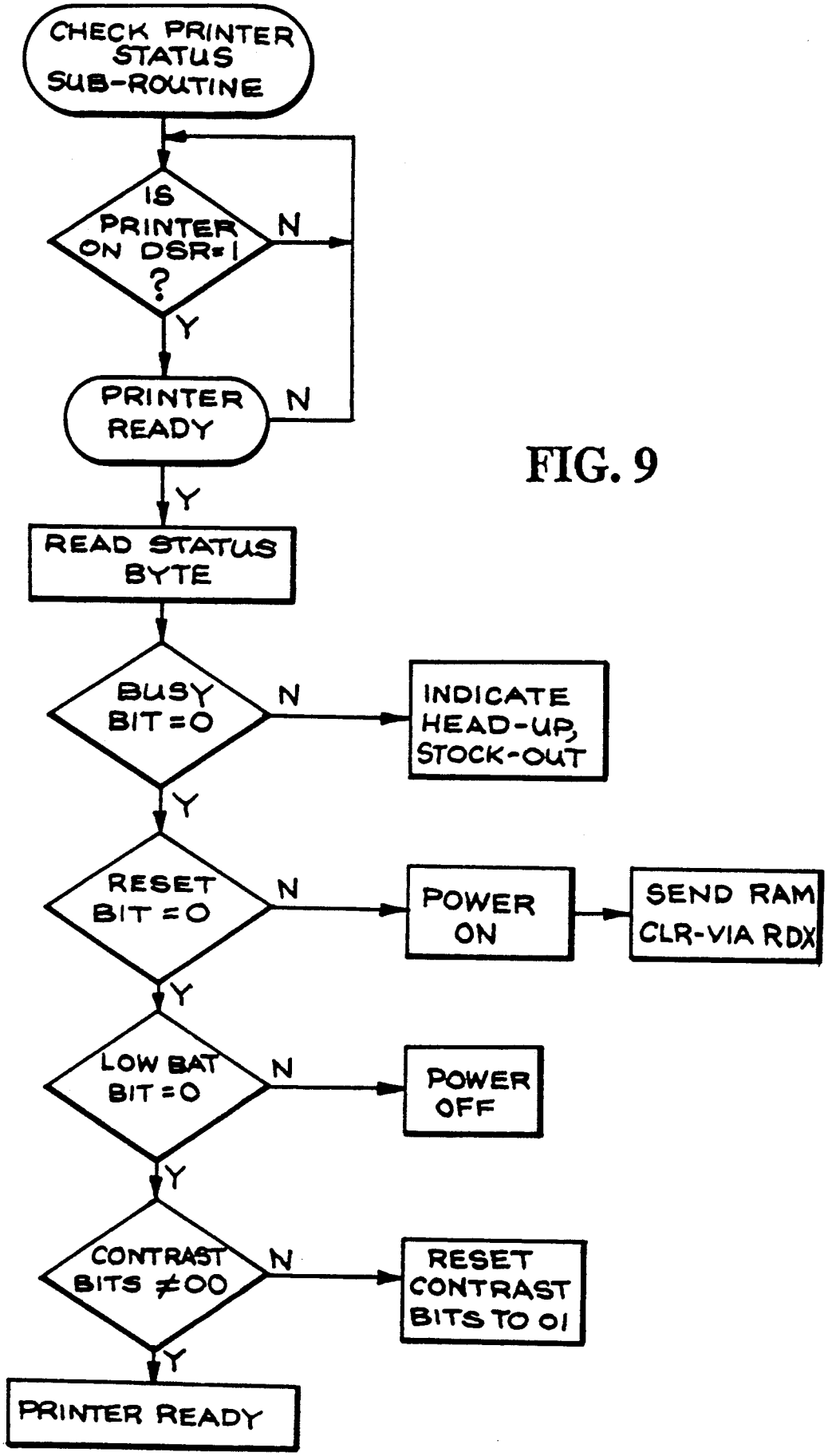
FIG. 9 is a flow chart of the subroutine for checking the printer status which is used in the program shown in FIG. 8.

Referring to FIG. 8, the print labels routine is invoked when a label is to be printed. The first process is to execute the check printer status subroutine which is shown in FIG. 9.

First there is the handshaking operation between the printer and the terminal using the DSR and CTS lines. If the printer is on and not busy the status byte is then read. Each bit is assembled into the status byte and transmitted to the terminal on the RXD line, indicating to the terminal the status of the printer.

Figure 10:
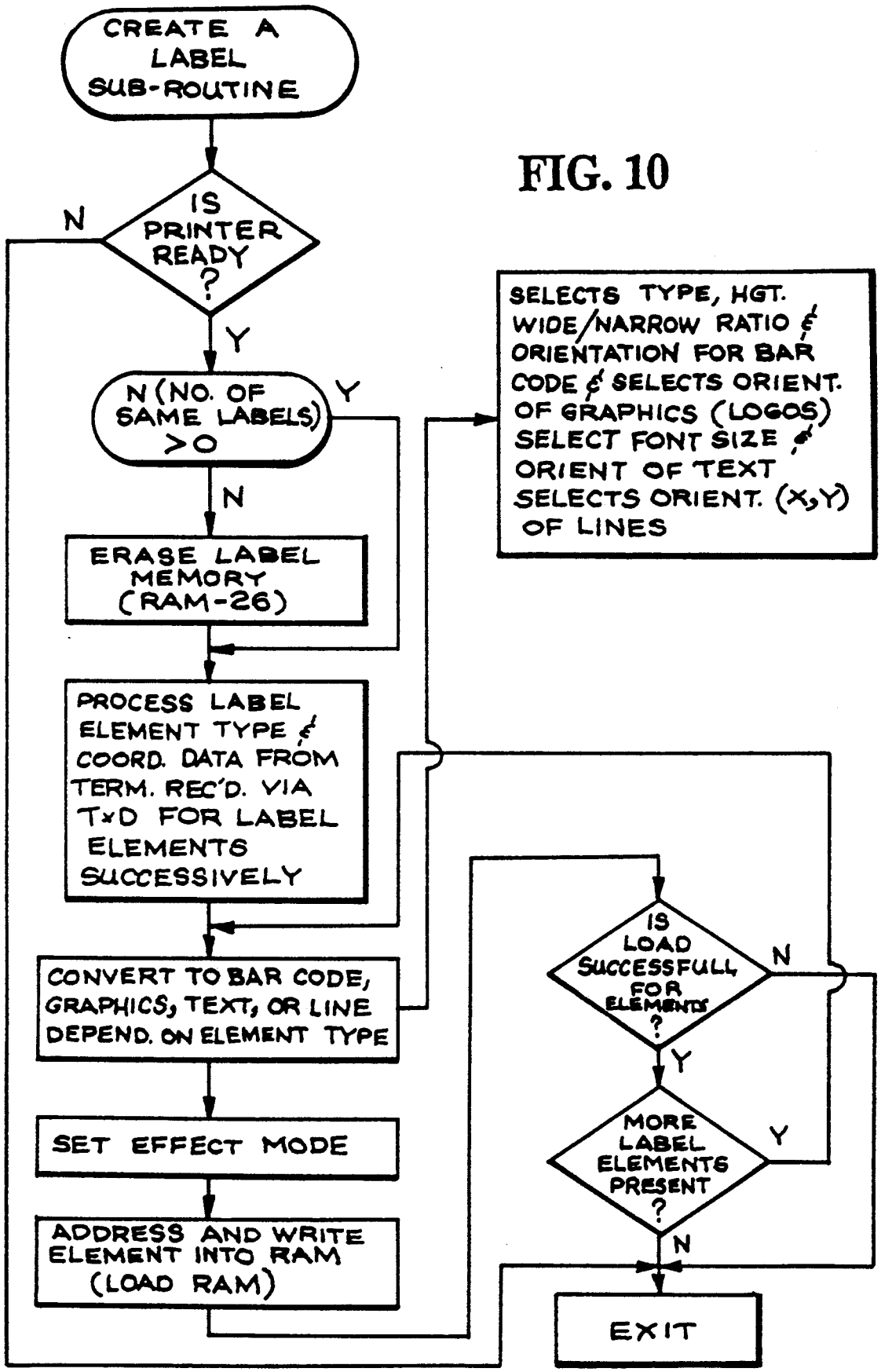
FIG. 10 is a flow chart showing the subroutine for creating the label (operating the printer) which is used in the program illustrated in FIG. 8.

When the printer is ready, commands are received from the terminal via the RXD line to either set the effect mode, the print contrast, the feed direction or to obtain certain reports, which will then be sent via the TXD line back to the terminal. For example, the controller may report battery level, serial number or odometer (ODM) reading via the TXD line so that it can be available to the terminal and printed out or displayed in a printer or display associated with the terminal. After the reports and commands are handled, a command arrives to create a label. The create a label subroutine shown in FIG. 10 is then invoked. First the printer ready subroutine is checked. Then data indicating the number N of the same label is checked. If the same label is to be printed, the program proceeds to process the label element, type and coordinate data from the terminal which is received via the TXD line for each label element. If a new label is to be printed (i.e. N=0) the portion of the memory 36 containing the previous label is erased and the process to enter the program which concerns label elements of various type and to locate those elements in desired coordinates on the label is invoked.

The element types are bar codes, graphics (logos), text, or lines. Different data conversion programs are executed depending on element type. For bar codes the programs select different kinds of code and the height and the width of the bars and spaces. There bar code types and fonts for text are stored in memory of the controller (in EPROM 28).

The effect mode is selected in accordance with the command therefor. Then the data in format for printing is entered into the RAM to provide a map of the label in memory space.

Returning to FIG. 8, the label is printed by reading out data from RAM into the head array 44, one 64 bit segment of each line at a time. The 64 bit segments are successively printed to create (print) the label.

If N is not greater than zero the process returns to print the same material on the next label.

If a new label is to be printed with fresh material, the check status routine is again invoked. However before reprinting, the reset bit is checked because, if it is high, the printer has been powered down. This is quite likely since it is desirable to turn the printer off, except when it is to print a label, for battery power conservation purposes. An acknowledge command is received from the terminal to assure that the terminal's program to output data and commands for the label will be transmitted to the printer 12.

From the foregoing description it will be apparent that there has been provided an improved printer which may be implemented as a miniature, portable, intelligent, and interactive device. Variation and modifications of the herein described printer within the scope of the invention, will undoubtedly suggest themselves to those skilled in the art. Accordingly, the foregoing description should be taken as illustrative and not in a limiting sense.

We claim:

1. A printer responsive to data represensting information to be printed and control commands from a terminal said printer comprising a printer mechanism having printing elements, a spool for receiving a roll of web stock on which printing is carried out in successive lines by said printing elements of said printing mechanism, said printing mechanism having means for feeding said stock past said printing elements, an electronic controller responsive to said commands and data for operating said printing mechanism and having means for generating data representing the operating state of said printing mechanism and transmitting said state data to said terminal, and a housing containing said printing mechanism, said spool, and said controller, said housing, said printing mechanism, said spool and said controller comprising an integrated assembly having a weight not exceeding about 2 pounds and a volume not exceeding about 80 cubic inches, said housing having opposite side walls, a front wall and a rear wall, an opening in said front wall, said printer mechanism having a platen roller which extends across said opening in said front wall, means in said housing defining a path of travel for said web around said roller, said web having opposite surfaces one of which is disposed on said roller as said web travels around said roller along said path and the other of which has labels of web material releasably attached thereto which separate from said other surface as said web travels around said roller, a peeler bar having a surface and an edge, said bar extending across said opening with said edge adjacent to said roller having a gap through which said web passes while said labels are engaged by said bar along said edge and said surface thereof.

2. The printer according to claim 1 further comprising a battery pack attachable to said housing as an additional part of said assembly for powering said mechanism and said controller, and said assembly of said printer and said pack not exceeding said weight and volume.

3. The printer according to claim 1 further comprising key pad means representing keys providing signals to said controller, said key pad being disposed on said housing on a exterior surface thereof.

4. The printer according to claim 1 further comprising means movably mounting said bar to said housing to enable said bar to be moved between peeling and threading positions closer and further from said roller, respectively, for increasing the width of said gap for threading said web through said gap.

5. The printer according to claim 4 wherein said movable mounting means comprises pins on which said bar is pivotally mounted, and means for releasably retaining said bar in said peeling position.

6. The printer according to claim 1 wherein said surface of said bar is defined by the edges of a plurality of ribs extending away from said edge of said bar.

7. The printer according to claim 1 wherein said housing has a recess in one of said side walls, said recess extending toward the other of said side walls, said spool being rotatable and having a rotation axis extending in a direction between said side walls, said path defining means comprising a member defining a funnel disposed between said recess and said roller, said funnel having an opening having an inlet end for said stock facing said recess and an outlet end facing said roller, said inlet end and said outlet end of said funnel opening being generally rectangular, said funnel tapering inwardly from said inlet to said outlet end.

8. The printer according to claim 7 wherein said recess has a first section encompassing said spool and a second section adjacent to said inlet end of said opening to provide access to said stock adjacent to said inlet end of said opening.

9. The printer according to claim 1 wherein said housing has front and rear walls and side walls, one of said side walls having an opening providing access to said spool, means cantilever mounting said spool for rotation about an axis extending in a direction between said side walls, said spool having a conical peripheral surface tapering inwardly along said axis in the direction towards said opening in said one of said side walls, and a tubular collar having a flange which is received around said spool between said roll of stock and said spool with said flange against said roll for mounting said roll on said spool for rotation therewith notwithstanding the axial length of said roll.

10. The printer according to claim 1 wherein said housing has front and rear walls and side walls, one of said side walls having an opening providing access to said spool for mounting a roll of said stock thereon for rotation therewith, said printer mechanism being disposed adjacent to said front wall, an opening in said front wall, said printer mechanism having a platen roller with an axis extending in a direction between said side walls and around which roller the web is disposed, said roller facing said opening, means extending across said opening adjacent to said roller for peeling labels which are adhesively and releasably attached to said stock from said stock as it leaves said roller, said label passing through said opening when released, and a take-up mechanism for said stock from which said labels are released comprising a shaft extending across said opening on which said web is wound, and means for rotating said shaft to wind and take up said web thereon.

11. The printer according to claim 1 wherein said housing has a front wall with an opening therein through which labels releasably and adhesively attached to said web pass, said housing having side walls one of which has an opening exposing said spool for mounting of a roll of said web with said labels thereon, said printer mechanism being disposed adjacent to said front wall and having a platen roller extending across said opening over which said web and labels pass while said printing elements print on individual ones of said labels, said housing having a top wall extending between said side walls and between said front and rear walls, said controller being mounted under said top wall and being connected to said printer mechanism.

12. The printer according to claim 1 further comprising a key pad on said top wall, said key pad being connected to said controller.

13. The printer according to claim 1 wherein said web has opposite surfaces on one of which labels which are printed by said printing elements of said printing mechanism are releasably and adhesively attached, said web having lines printed across said web and disposed in spaced relationship with said labels to indicate the location of said labels on said web, said printing mechanism having means for detecting said lines, and means in said controller responsive to said detecting means for operating said mechanism to feed said web to locate said labels individually with respect to said printing elements.

14. The printer according to claim 13 wherein said controller includes means for feeding said web for a given period of time or until one of said lines is detected, whichever occurs first.

15. The printer according to claim 13 wherein said controller has means for counting the number of said lines which are detected, and means for recording the length of paper which travels past said printing mechanism corresponding to said number of lines.

16. A printer having a housing containing a printing mechanism having printing elements and an electronic controller for receiving commands and data from a terminal for operating said printing mechanism, and means for holding a web of stocks for receiving printing, wherein said controller has a data input line from said terminal (TXD), a data output line from said terminal (RXD), said operating commands and said data for operating said printing mechanism being transmitted on said TXD line and said data representing the operating state of said machine being transmitted on said RXD line, said controller having means responsive to control commands selected from the group consisting of a print contrast command, a command to control printing effects, a serial number of the printer reporting command, a battery level reporting command, a web feed direction command, and a total length of web printed reporting command, and a total length of web printed reporting command, said controller having means for generating multi-bit data signals different bytes of which represent status data consisting of data representing the printing mechanism being busy in process of printing, the web being out of said printing mechanism, the printing elements being in position to print, the power to the controller having been turned off and the on again, the feed direction of said web, and the print contrast.

17. The printer according to claim 16 wherein said controller has an input line from said terminal (DTR) for commanding the controller to apply power to the printing mechanism, and such controller has an output line to said terminal (DSR) for a signal indicative of whether said printing mechanism is on or off.

18. The printer according to claim 16 wherein said controller has an input line from said printer (RTS) for a signal indicative of whether the terminal is ready to send commands and data, and said controller has an output line to said terminal (CTS) indicative of whether said printer is ready to accept said commands and data.

19. The printer according to claim 16 wherein said controller includes a microprocessor and associated RAM wherein data representing a block of information for operating said printing elements is stored and a ROM associated with said microprocessor wherein programs for converting data from said terminal into bar code, graphics, text, or line representing data addressable to said RAM is stored.

* * * * *